United States Patent [19]

Ludwig, Jr.

[11] 4,315,578

[45] Feb. 16, 1982

[54] SAFETY CLOSURE CAP WITH VENT

[75] Inventor: Clifford J. Ludwig, Jr., Southgate, Ky.

[73] Assignee: The Drackett Company, Cincinnati, Ohio

[21] Appl. No.: 187,924

[22] Filed: Sep. 17, 1980

[51] Int. Cl.[3] ..... B65D 83/10

[52] U.S. Cl. ..... 220/366; 220/281; 220/307; 215/211; 215/307

[58] Field of Search ..... 215/211, 224, 307; 220/306, 307, 366, 281

[56] References Cited

U.S. PATENT DOCUMENTS

| | | | |
|---|---|---|---|
| D. 195,372 | 6/1963 | Worsley | D9/439 |
| D. 207,356 | 4/1967 | McCormick | D9/439 |
| D. 230,574 | 3/1974 | Commisso | D9/439 |
| D. 241,621 | 9/1976 | Morris | D9/443 |
| D. 243,231 | 2/1977 | Smith | D9/439 |
| 1,865,764 | 7/1932 | Keenan | 215/260 |
| 2,789,719 | 4/1957 | Wheaton | 215/260 |
| 3,011,671 | 12/1961 | Waber | 215/260 |
| 3,151,757 | 10/1964 | Martin | 215/260 |
| 3,179,283 | 4/1965 | Amberg | 220/306 |
| 3,239,091 | 3/1966 | Driscoll | 215/260 |
| 3,310,193 | 3/1967 | Macpherson | 215/260 |
| 3,393,818 | 7/1968 | McIntosh | 215/260 |
| 3,398,848 | 8/1968 | Donovan | 215/224 |
| 3,642,167 | 2/1972 | Kinney | 220/306 |
| 3,966,082 | 6/1976 | Hopkins | 220/306 |
| 3,976,216 | 8/1976 | Lambert | 215/307 |
| 4,043,474 | 8/1977 | McCord | 215/211 |

*Primary Examiner*—George T. Hall

*Attorney, Agent, or Firm*—Sharon A. Blinkoff; George A. Mentis

[57] ABSTRACT

A safety closure cap capable of venting excess pressure within a container is disclosed. The safety closure cap is a unitary device made of a flexible material, constructed to seal a container having an orifice surrounded by an upstanding rim. The safety closure cap is comprised of a disc having a retaining lip; an annular ring which is parallel to the disc and connected thereto by a short annular wall; a pull tab connected to the periphery of the annular ring; a sealing skirt extending outwardly and downwardly from the annular ring which is adapted to substantially overlap the container rim; a venting channel adapted to vent gasses within the container which extends across the periphery of the annular wall from the retaining lip portion to the outer periphery of the annular ring, and two vertical gripping members disposed respectively on upper and lower surfaces of the pull tab.

8 Claims, 6 Drawing Figures

SAFETY CLOSURE CAP WITH VENT

BACKGROUND OF THE INVENTION

This invention relates to safety closure caps adapted for sealing containers having orifices defined by an annular rim. More particularly this invention relates to safety closure caps which vent gasses when the pressure in the container exceeds a given value, and which seal the container when the internal pressure in the container is below a given value, thereby preventing moisture in the atmosphere from contacting the contents of the container.

Many products formulated for use as household products such as drain cleaners, toilet bowl cleaners, and the like are sold in containers or vessels having at least one opening through which the product is dispensed. To be effective many of these products are potent and, therefore, may be harmful if ingested by a child. Thus, it is necessary that a container closure intended for use with such household product be constructed so that is would be quite difficult, if not impossible, for a child to remove and yet easily removed by the intended year. Further, since these products, as sold, contain sufficient amounts of the product to enable multiple uses, the closure cap must also be relatively easy for the intended user to replace on the container.

In addition to the considerations discussed above, the closure cap must also be relatively inexpensive. Since the product is relatively inexpensive, it would not be economically feasible to use a closure that substantially adds to the cost of the end product.

Another problem which is encountered with these household products is in storing them in warehouses prior to sale. When temperatures in the warehouse are not controlled so that they become elevated the product stored in the individual containers may tend to react to form gasses. This will create excessive pressure in the container, and may cause the caps to pop off the containers. Therefore, it is desirable that closure caps used with these products have a mechanism for venting these gasses. However, since most of these products would tend to become less effective or deactivate if exposed to the moisture in the atmosphere it is also necessary that the closure be able to seal the contents of the container from contact with the atmosphere both before and after venting.

A further problem encountered in storing these types of products in a warehouse is created by the necessity of stacking the containers one on top of another. In stacking, if the weight from an upper container is allowed to rest on the closure cap of a lower container, the cap could be deformed thereby possible causing it to become defective. Therefore, it is necessary that the weight of an upper container be supported by the lower container rather than the cap, thereby preventing the total weight from resting directly on the closure.

Safety closure caps known in the prior art are exemplified by U.S. Pat. No. 4,043,473 to McCord and U.S. Pat. No. 3,966,082 to Hopkins.

The McCord patent discloses a plug-type closure which has several lugs disposed on the bottom of the plug which cooperate with recesses formed in the orifice of the container to lock the closure into the container thereby rendering it difficult for a child to open.

The Hopkins patent discloses a two part safety closure comprised of a rotatable annular collar and a snap fit overcap. The overcap is locked onto the container through the annular collar.

A drawback of these prior art safety caps is that they don't provide a mechanism for releasing excessive pressure within a container.

SUMMARY OF THE INVENTION

This invention is directed toward a unitary, ventible safety closure cap for a container having an orifice surrounded by an annular rim. The safety closure cap comprises: a disc, which is surrounded at its periphery by a lip; an annular ring disposed in a plane parallel to the disc portion having an annular groove for mating with the annular rim of a container; a short annular wall which connects the annular ring with the lip of the disc; an annular sealing skirt which extends generally outwardly and downwardly from the periphery of the annular ring, and which is adapted to contact the outer periphery of the annular rim of the container; a pull-tab extending from the periphery of the annular ring having a free end with upper and lower surfaces; at least one venting channel which extends across the retaining lip portion to the outer periphery of the annular ring portion until but not past the sealing skirt portion; and a first and second vertical gripping member, wherein said first vertical gripping member is disposed along the periphery of the free end of the pull tab on the upper surface thereof; and wherein said second vertical gripping member is disposed along the periphery of the free end of the pull tab on the lower surface thereof.

To engage the safety closure cap in the orifice of a container the cap is placed on the orifice and pushed down upon so that the safety closure cap is deformed thereby allowing the retaining lip to pass through the orifice of the container thereby snapping it into engagement with the orifice of the container. The overlapping configuration formed by the sealing skirt of the safety closure cap and the annular rim of the container will substantially prevent the ambient atmosphere from communicating with the contents in the container. However, when the pressure in the container exceeds that of the atmosphere, the sealing skirt will be flexed outward by gasses trapped in the venting channel thereby permitting gasses in the container to be released through the channel.

When the safety closure cap is engaged in the orifice of the container the retaining lip which extends under the rim of the container keeps the safety closure cap from being easily removed by a child. However, it is easily removed by an adult, by pressing down at the center of the cap while lifting up on the pull tab by grasping the first and second vertical gripping members. These gripping members enable the user to obtain the grip necessary to provide the leverage required to remove the safety closure cap. When stored one container may be stacked on another and the weight of the upper container will be transmitted to the rim of the lower container through the annular ring portion of the safety closure cap.

It is an object of this invention to provide a cap which is readily removable from a container by an adult and yet almost impossible for removal by a child, and which substantially seals the interior of the container from contact with the atmosphere, and which can automatically vent any undesirable excess pressure within the closed container.

DETAILED DESCRIPTION OF THE PREFERRED EMBODIMENT

Figure 2:
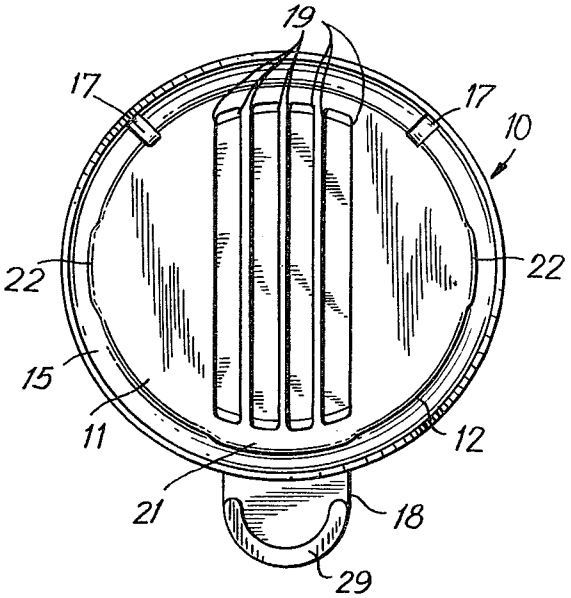
FIG. 2 is a bottom view of the embodiment shown in FIG. 1.
Figure 3:
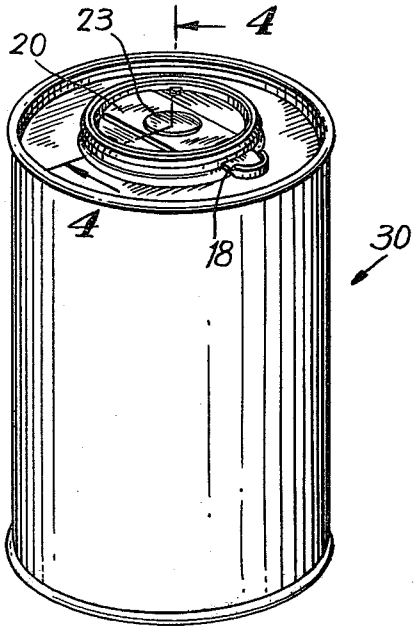
FIG. 3 is a side elevational view showing the embodiment of FIG. 1, engaged in the opening of a container.
Figure 4:
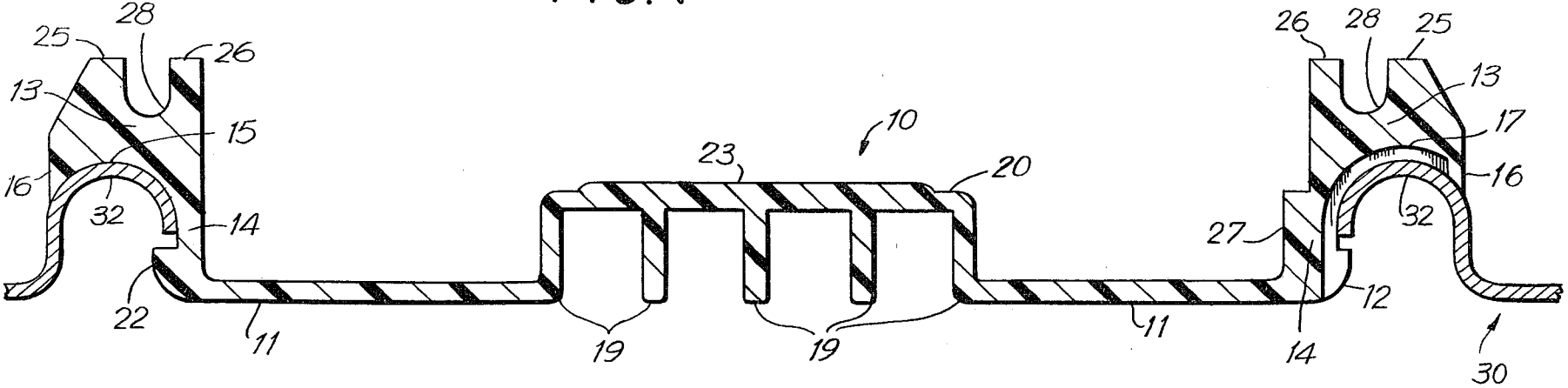
FIG. 4 is a sectional view taken along line 4—4 of FIG. 3 showing a cross section which has been taken in part through a venting channel.
Figure 6:
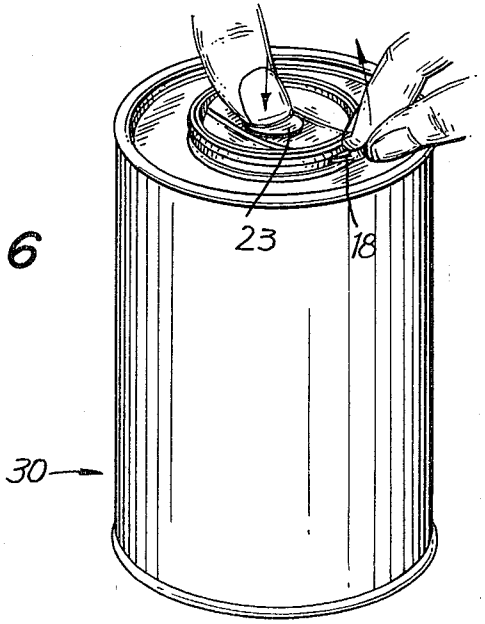
FIG. 6 is a plan view showing the removal of the embodiment of FIG. 1 from a container.

The preferred embodiment of the present invention is illustrated by way of example in FIGS. 1–6. As shown in FIGS. 3 and 4 the safety closure cap 10 has been adapted for use in conjunction with a container 30 having an orifice surrounded by an annular rim 32.

Figure 1:
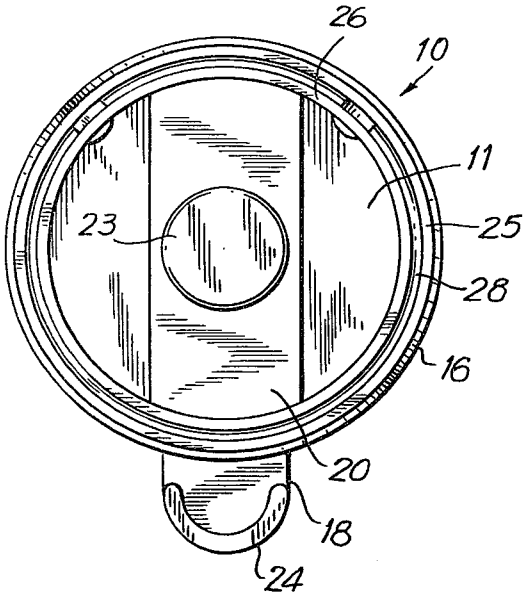
FIG. 1 is a plan view of a preferred embodiment of the safety closure cap of this invention.

With specific reference to FIGS. 1, 2 and 4 the safety closure cap includes a disc portion 11 which is surrounded at its edge by a retaining lip portion 12. An annular ring portion 13 is disposed in a plane parallel to the disc portion 11 and is connected to both the disc portion 11 and the retaining lip portion 12 by a short annular wall portion 14. The annular ring portion 13 has an annular groove 15 formed along the entire length of its lower side. An annular sealing skirt portion 16 extends outwardly and downwardly from the periphery of the annular ring portion 13. As is best shown in FIGS. 1 and 2, a pull tab 18 extends out horizontally from the periphery of the annular ring portion 13. A first and second vertical gripping member, 24 and 29 respectively, are disposed along the periphery of the free end of the pull tab 18 and extend vertically therefrom. The first vertical gripping member 24 is disposed on the top surface of pull tab 18, while the second vertical gripping member 29 is disposed on the bottom surface of pull tab 18. Preferably these vertical gripping members each extend about 1/20 of an inch vertically from the pull tab. As is best shown in FIG. 4, two venting channels 17 extend across the periphery of the annular wall portion from the retaining lip portion 12 to the outer periphery of the annular ring portion 13 but not past the sealing skirt portion 16.

As is best shown in FIGS. 2 and 4 the closure cap 10 includes a series of stiffener ribs 19 which are disposed across the diameter of the disc portion 11 from a point on the disc portion 11 which is aligned with the pull tab 18. These stiffener ribs extend vertically upward from the disc portion 11 and are joined at their uppermost point by a planar member 20 shown in FIGS. 1 and 4. A plurality of protrusions are formed along the retaining lip portion 12, a primary protrusion 21 located at a point on retaining lip portion 12 which is directly below the pull tab 18, and two secondary protrusions 22 located at points on the retaining lip portion 12 which are at approximately 90° angles to the primary protrusion 21. A deep U shaped recess 28 is formed in upper central portion of the annular ring portion 13 and extends around the full length of the annular ring portion 13, thereby forming two ridges on the annular ring an outer ridge 25 and an inner ridge 26. An upstanding circular finish 23 is located centrally on the planar member 20 of the safety closure cap. Additionally, a short wall 27 is formed on annular wall portion 14 adjacent each of the venting channels 17. This wall 27 provides additional thickness to the annular wall portion 14, so that the annular wall portion adjacent to the venting channel has a uniform thickness.

The safety closure cap of this invention is a unitary device which can be made by conventional injection molding techniques. It is made from a flexible material such as a synthetic resin or natural rubber. The material which is preferred is low density polyethylene or a polyester elastomer.

In operation the safety closure cap is snapped into engagement with a container having the orifice and rim configuration discussed above and shown in FIG. 3. As can best be seen in FIG. 4, the sealing skirt portion 16 will substantially overlap the rim 32 of the container thereby sealing the contents of the container from contact with the atmosphere. The retaining lip portion 12, as also shown in FIG. 4, extends under the rim of the container thereby locking the safety closure cap 10 onto the container 30.

Figure 5:
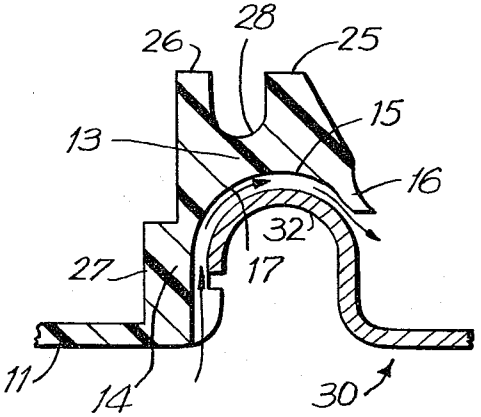
FIG. 5 is a cross sectional view of the embodiment of FIG. 1 showing the sealing skirt flexed outward in response to pressure build up in the container and showing the release of gasses through the venting channel.

When the containers are exposed to unregulated temperatures, such as during storage in a warehouse, where the temperature can rise to levels that cause the contents of the container to emit gasses; gasses will become trapped in the venting channels 17. When the pressure exceeds a certain value the gasses will exert sufficient pressure on the sealing skirt portion 16 to cause it to be flexed outwardly, thereby disengaging it from the container rim 32. While so disengaged the gasses trapped in the container will be able to flow out of the container, as shown in FIG. 5. After the gasses in the container have been released the pressure on the sealing skirt portion 16 will fall, thereby permitting it to return to its previous position in engagement with the rim 32 where it will once again prevent the contents of the container from being exposed to moisture in the ambient atmosphere.

In storage it is customary for containers to be stacked. When containers, which are sealed with the safety closure cap of this invention, are stacked one on top of the other, each upper container will sit on the annular ring portion 13 of the safety closure cap of a lower container. Since the annular ring portion 13 rests on top of the container rim 32, the weight of the upper container will be transmitted to and carried by the container. This prevents distortion of the caps.

The safety closure cap of this invention can be removed by pressing down on the center of the cap while lifting up on the pull tab 18 by grasping the first and second vertical gripping members 24 and 29. However, easy removal of the cap, without pressing down at its center, is prevented by the retaining lip portion 12.

In the preferred embodiment of this invention which has the additional feature discussed above easy removal of the cap by such acts as placing a fingernail under the sealing skirt portion 16 and lifting up is further prevented by the primary protrusion 21 and secondary protrusions 22. The stiffener ribs 19 provide additional stiffness to the safety closure cap thereby preventing it from flexing and causing the safety closure cap to be deformed and removed when the pull tab 18 is pulled up. These features, the stiffener ribs 19 and the primary protrusion 21 and secondary protrusions 22 further render the safety closure cap almost impossible for a child to open. The circular finish 23 on the central portion of the planar member 20 provides for easy opening by the intended user by indicating the most advantageous point for the user to exert pressure. By pressing down with one thumb on the circular finish 23 the primary protrusion and the retaining lip will clear the rim of the container, and by pulling up on the pull tab 18, by gripping the first and second vertical gripping members 24 and 29, the safety closure cap will be readily removed.

Also this preferred embodiment will have two ridges formed in the annular ring portion 13 by the U shaped recess 28. The outer ridge 25 is advantageous for the purpose of stacking as discussed above while the inner ring 26 will provide for pick up by capping machinery used when the container is filled and the safety closure cap inserted into the orifice of a container.

The present invention provides an improved safety closure cap which is capable of venting gasses which may be generated within the container while also providing for the sealing of the contents of the container from the moisture in the ambient atmosphere. Additionally as a safety type cap there is provided a closure which is impossible for a child to remove. Further this invention provides a unitary device which can be made inexpensively by well known injection molding techniques.

While the present invention has been disclosed in connection with the preferred embodiment thereof, it should be understood that there may be other embodiments which fall within the spirit and scope of the invention as defined by the following claims.

I claim:

1. A safety closure cap for enclosing an orifice in a container comprised of:

(a) a disc portion;

(b) a retaining lip portion extending along the edges of the disc and surrounding the periphery thereof;

(c) an annular ring portion disposed in a plane parallel to the disc and having an annular groove formed on its lower side for mating with the opening of the vessel intended to be enclosed;

(d) a short annular wall portion which connects the annular ring with the lip of the disc;

(e) an annular sealing skirt portion which extends generally outwardly and downwardly from the periphery of the annular ring portion and being adapted to contact the edge of said orifice in a substantially overlapping configuration;

(f) a pull tab having a free end with upper and lower surfaces, which extends from the periphery of the annular ring;

(g) at least one venting channel which extends across the periphery of the annular wall portion from the retaining lip portion to the outer periphery of the annular ring portion until but not past the sealing skirt portion; and (h) a first and second vertical gripping member, wherein said first vertical gripping member is disposed along the periphery of the free end of the pull tab on the upper surface thereof, and wherein said second vertical gripping member is disposed along the periphery of the free end of the pull tab on the lower surface thereof, whereby said substantially overlapping configuration substantially prevents the ambient atmosphere from being in communication with the interior of the container when the pressure within the container is substantially equal to or less than that of the ambient atmosphere and whereby said skirt is flexed away from said substantially overlapping relation when the pressure in the interior exceeds a predetermined value and is released through said venting channel and through said sealing skirt into the atmosphere.

2. The safety closure cap of claim 1 wherein said cap is made from a single integrally molded piece.

3. The safety closure cap of claim 1 or 2 further comprising:

(a) A primary protrusion extending horizontally from the retaining lip;

(b) a plurality of secondary protrusions extending horizontally from the retaining lip and spaced from said primary protrusion; and (c) a plurality of stiffener ribs disposed across the diameter of the disc from opposite sides of the lip portions and extending vertically upwards therefrom.

4. The safety closure cap of claim 3 wherein said primary protrusion is disposed beneath the pull tab, and wherein the two secondary protrusions are each spaced at approximately a 90° angle to said primary protrusion.

5. The safety closure cap of claim 4 wherein said stiffener ribs are joined at their uppermost point by a planar member which is parallel to the disc and wherein said stiffener ribs extend from a point on the disc adjacent said primary protrusion.

6. The safety closure cap of claim 5 having a U shaped recess formed in the top central portion of the annular ring.

7. The safety closure cap of claim 6 having a first and a second venting channel, wherein said first venting channel is disposed on one side of said retaining ribs and is spaced therefrom, and wherein said second venting channel is disposed on an opposite side of said retaining ribs and is spaced therefrom.

8. The safety closure cap of claim 7 further comprising a circular protrusion centrally located on the planar member; and a short wall disposed on said annular wall portion adjacent each of said venting channels.

* * * * *